US007591606B2

(12) United States Patent
Moscovitch

(10) Patent No.: US 7,591,606 B2
(45) Date of Patent: Sep. 22, 2009

(54) METHOD AND SYSTEM FOR VEHICULAR TRAFFIC MANAGEMENT

(76) Inventor: Jerry Moscovitch, 474 Wellington Street West, Toronto (CA) M5V-1E3

( * ) Notice: Subject to any disclaimer, the term of this patent is extended or adjusted under 35 U.S.C. 154(b) by 0 days.

(21) Appl. No.: 11/733,667

(22) Filed: Apr. 10, 2007

(65) Prior Publication Data

US 2007/0237579 A1 Oct. 11, 2007

Related U.S. Application Data

(60) Provisional application No. 60/790,551, filed on Apr. 10, 2006.

(51) Int. Cl.
*E01F 9/047* (2006.01)

(52) U.S. Cl. ..... 404/15

(58) Field of Classification Search ..... 404/15
See application file for complete search history.

(56) References Cited

U.S. PATENT DOCUMENTS 1,843,746 A * 2/1932 Tibbetts ..... 404/15
2,031,396 A * 2/1936 Voight ..... 404/15
4,354,771 A * 10/1982 Dickinson ..... 404/6
D336,524 S * 6/1993 White et al. ..... D25/102
5,295,759 A * 3/1994 Flanders et al. ..... 404/15
6,174,103 B1 * 1/2001 Stroman ..... 404/15
6,259,375 B1 * 7/2001 Andras ..... 340/907
6,309,137 B1 * 10/2001 Hirsch ..... 404/15
6,623,206 B1 * 9/2003 Blair et al. ..... 404/16

* cited by examiner

*Primary Examiner*—Gary S Hartmann

(57) ABSTRACT

A speed bump system and method for a roadway that encourages a driver of a passenger vehicle to slow down and that does not substantially impede an emergency vehicle are described herein. The system includes a structure for disposing across the roadway to encourage the driver of a passenger vehicle to slow down before driving over the structure. In one embodiment, the structure has a raised middle portion, a first raised outer portion proximal to one end of the raised middle portion, and a second raised outer portion proximal to the other end of the raised middle portion. The three raised portions are traversable by the passenger vehicle. The structure further includes a first gap between the first raised outer portion and the raised middle portion, and a second gap between the second raised outer portion and the raised middle portion. The width of the first gap, the width of the second gap and the distance between the first and second gaps allow the emergency vehicle to pass through the first and second gaps.

1 Claim, 12 Drawing Sheets

METHOD AND SYSTEM FOR VEHICULAR TRAFFIC MANAGEMENT

FIELD OF THE INVENTION

The invention relates to vehicular traffic management, and more particularly to managing such traffic using speed bumps.

BACKGROUND OF THE INVENTION

Speed bumps are a widespread means for controlling traffic. They are often used in locations where the potential for collisions is greater than normal, such as in construction zones, toll ways, entrance and exit ramps, school zones and residential areas.

A typical speed bump is a permanent structure integrated with a road surface, such as an asphalt, concrete, or steel structure whose shape resembles that of a cylinder sliced longitudinally. The speed bump is placed across a road to encourage drivers of vehicles to slow down when passing thereon lest they suffer a large jolt.

Despite their effectiveness, there is at least one drawback associated with conventional speed bumps. Emergency vehicles, such as ambulances, police cars and fire trucks, are forced to slow down when traversing a speed bump in a roadway, resulting in greater emergency response times.

Thus, there is a need for a method and system that has the benefit of conventional speed bumps for curtailing the speed of vehicles, while at the same time not hampering the motion of emergency vehicles.

SUMMARY OF THE INVENTION

An improved traffic management method and system are described herein. In accordance with one aspect of the present invention, a speed bump system and method are described that provide for gaps to allow an emergency vehicle to pass therethrough. In one embodiment that can be implemented when the tire configuration (e.g., width of tires, number of tires, distance between front tires, distance between rear tires) of the emergency vehicle is substantially different from that of a regular passenger vehicle, the speed bump system is designed to allow an emergency vehicle to pass through the gaps, but to not allow the regular passenger vehicle to pass through the gaps. In another embodiment, both an emergency vehicle and a regular passenger vehicle are physically capable of passing through the gaps of the speed bump system. Effectiveness of the speed bump system could, in part, then stem from prohibiting by law a regular passenger vehicle to pass through the gaps.

The speed bump system can be pre-fabricated or constructed on site. Reflectors can be disposed between the gaps to increase visibility for emergency vehicles at night.

DETAILED DESCRIPTION OF THE INVENTION

A speed bump system is described below that provides the traditional benefits of speed bumps, viz., reducing speeds of cars, while not impeding the speed of emergency vehicles.

Figure 1A:
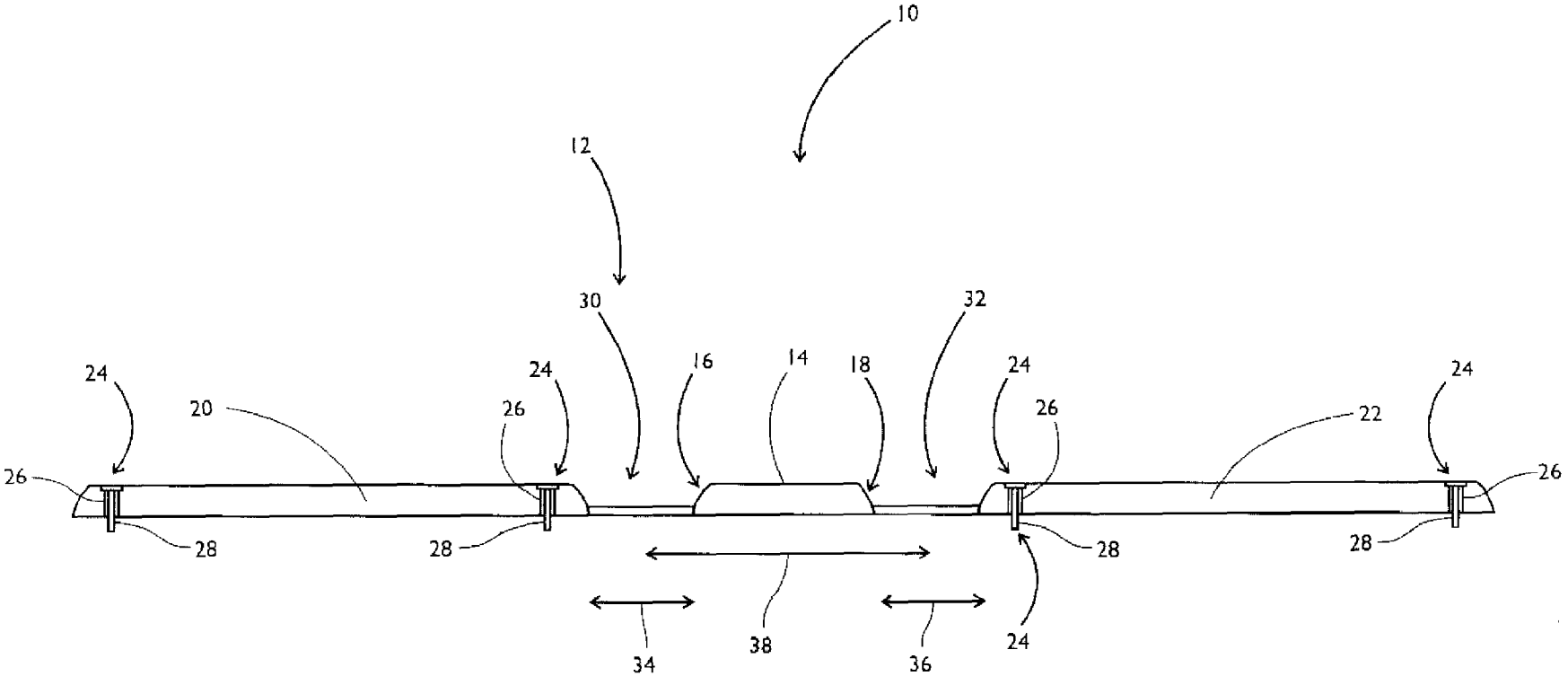
FIG. 1A shows a cross-sectional view of a speed bump system, according to the principles of the present invention.

FIG. 1A shows a cross-sectional view of a speed bump system 10 for a roadway that encourages a driver of a vehicle to slow down. The system 10 is designed, however, to not impede an emergency vehicle. An emergency vehicle can include an ambulance, a fire truck and/or a police car, for example.

The speed bump system 10 includes an elongate structure 12 having a raised middle portion 14 with two ends 16 and 18. The elongate structure 12 also has a first raised outer portion 20 that is proximal to the one end 16 of the raised middle portion 14, and a second raised outer portion 22 that is proximal to the other end 18 of the raised middle portion 14. The speed bump system 10 also includes affixing means 24 that can include holes 26 and screws 28 threaded therethrough and screwed to the roadway. Any other type of affixing means, such as bolts, nails, spikes, rivets or bonding material can also be used. Tn some instance, as when using concrete, asphalt or tar, the speed bump system may be self-bonding to the roadway when set. Other methods and components for constructing speed bumps, known to those of ordinary skill in the art, may also be used.

The speed bump system 10 also includes a first gap 30 and a second gap 32. The first gap 30 lies between the first raised outer portion 20 and the raised middle portion 14. The second gap 32 lies between the second raised outer portion 22 and the raised middle portion 14.

In the simplest case, the emergency vehicle has two front tires, and two back tires, and the distance between the two front tires and the distance between the two rear tires is substantially the same. The width 34 of the first gap 30 (the "intragap width") and the width 36 of the second gap 32 are then each chosen to be wider than the width of the widest tire tread of the emergency vehicle. Moreover, the distance 38 between the first and second gaps 30 and 32 (the "intergap width") is chosen to be substantially the same as the distance between the two rear tires of the emergency vehicle, which in this example is substantially the same as the distance between the two front tires. The intergap width can be measured from the center of the first gap to the center of the second gap, if the width between front (or rear) tires is also measured from the respective centers of the two front (or rear) tire treads.

Figure 1B:
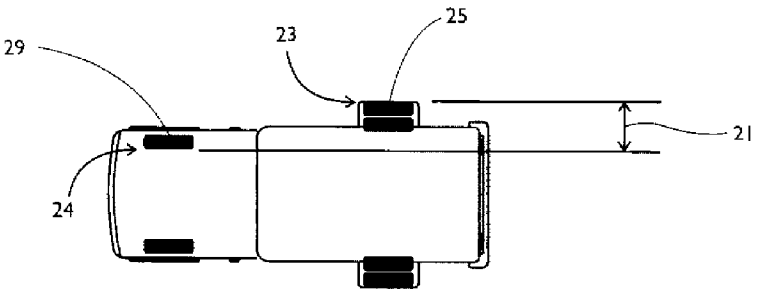
FIG. 1B shows a tire configuration of an emergency vehicle.

Some emergency vehicles have two tires at the location of one tire well. For example, certain fire trucks or ambulances have a single front right tire, a single front left tire, but two rear right tires and two rear left tires. In such cases, the width of a left first gap is wider than both left rear tires (i.e., wider than the distance between the outer edge of the tread of the outer left tire, and the inner edge of the tread of the inner left tire), and the width of a right second gap is wider than the two rear right tires. In this last example, it is assumed that the left front tire tread lies between the two left rear front tires if longitudinally projected there. This last assumption ensures that when the emergency vehicle is traveling straight ahead along a roadway, the two front tires can pass the gap if the two rear wheels can. If this assumption is not true, such as when the tire configuration of the emergency vehicle is like that shown in FIG. 1B, the intragap distance of the second or right gap should be larger than the transverse distance 21 between the edge 23 of the tread of the outermost tire 25 and the inner edge 27 of the inner most tire 29. Analogous considerations apply for the first or left gap.

Generally, where the speed bump is tailored for one or more emergency vehicles, including vehicles where the distance between two front tires and the distance between two rear tires are not equal, and/or where the vehicle has a plurality of wheels at a single wheel well, the width of the individual gaps (the "intragap width or distance") and the distance between the gaps (the "intergap distance") should be such as to allow the emergency vehicle to pass the speed bump system through the gaps.

In the embodiment shown in FIG. 1A, the first raised outer portion 20, the raised middle portion 14 and the second raised outer portion 22 are substantially collinear.

Figure 1C:
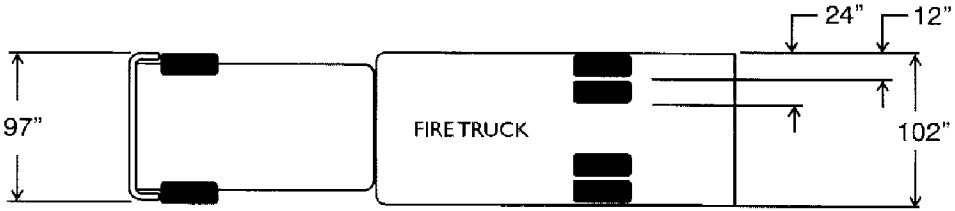
FIG. 1C shows exemplary dimensions of a fire truck.
Figure 1D:
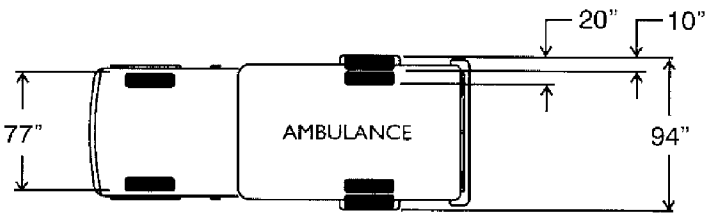
FIG. 1D shows exemplary dimensions of an ambulance.
Figure 1E:
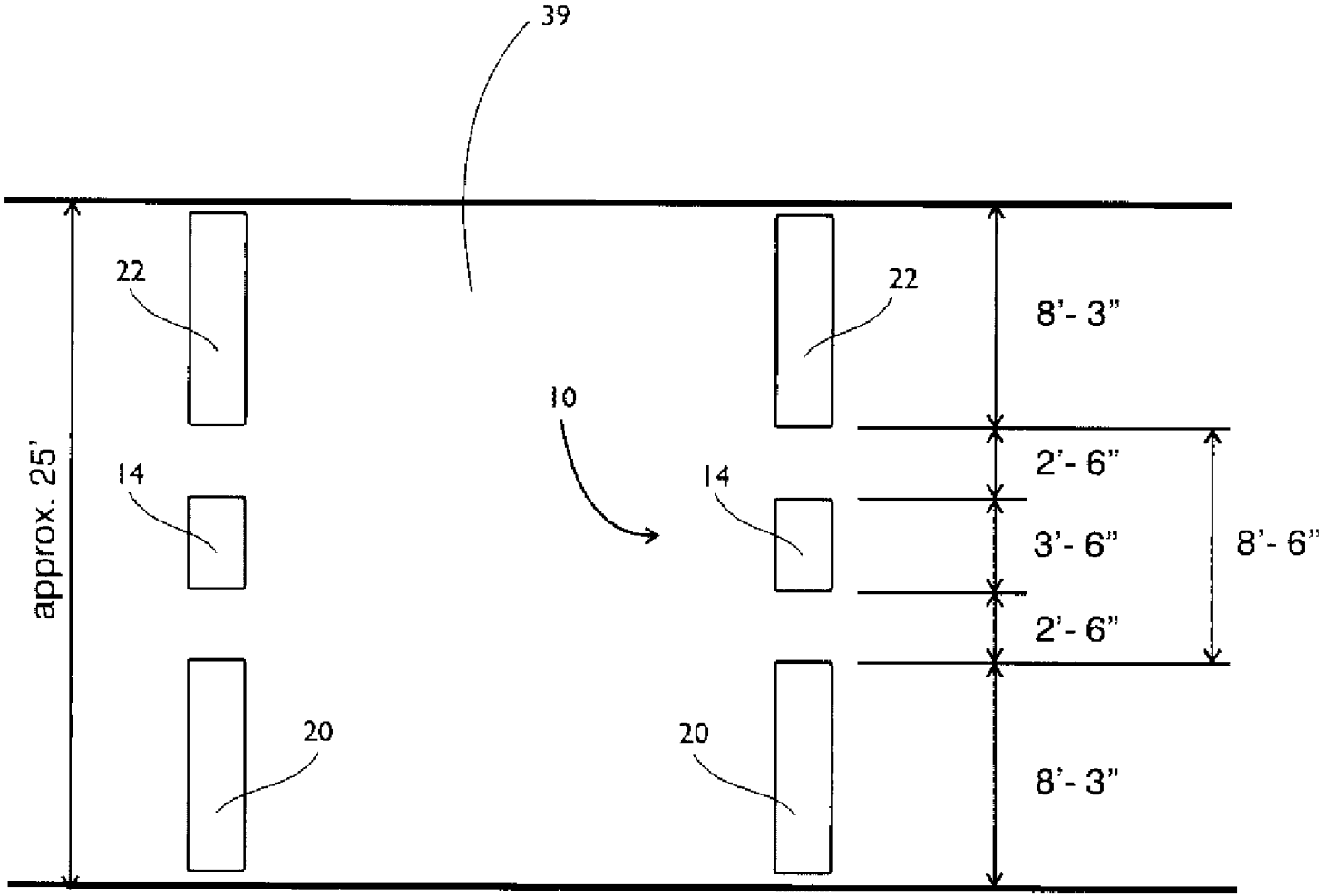
FIG. 1E shows exemplary dimensions of a speed bump system, according to the principles of the present invention.

FIGS. 1C, 1D and 1E show some exemplary dimensions of a fire truck, an ambulance and the speed bump system on a roadway 39 of the present invention. In one embodiment of the present invention, the speed bump system exploits the fact that the distance between the back (or front) wheels of a fire truck or other emergency vehicle, is larger than the analogous distance in a regular passenger vehicle. If such is the case, the intragap distance and the intergap distance may be able to be chosen so that it is possible for the fire truck or other emergency vehicle to travel between the gaps unimpeded, but it is not possible for a regular passenger vehicle to pass the speed bump system without going over at least one of the raised portions.

More generally, provided the wheel geometry of the emergency vehicle and the wheel geometry of the regular passenger vehicle is sufficiently different, then the intragap and intergap distances can be chosen such that a) the emergency vehicle is able to pass the speed bump system through the gaps, avoiding the raised portions, and b) the passenger vehicle is not able to pass the speed bump system through the gaps, but must instead traverse at least one of the raised portions of the system.

Figure 1F:
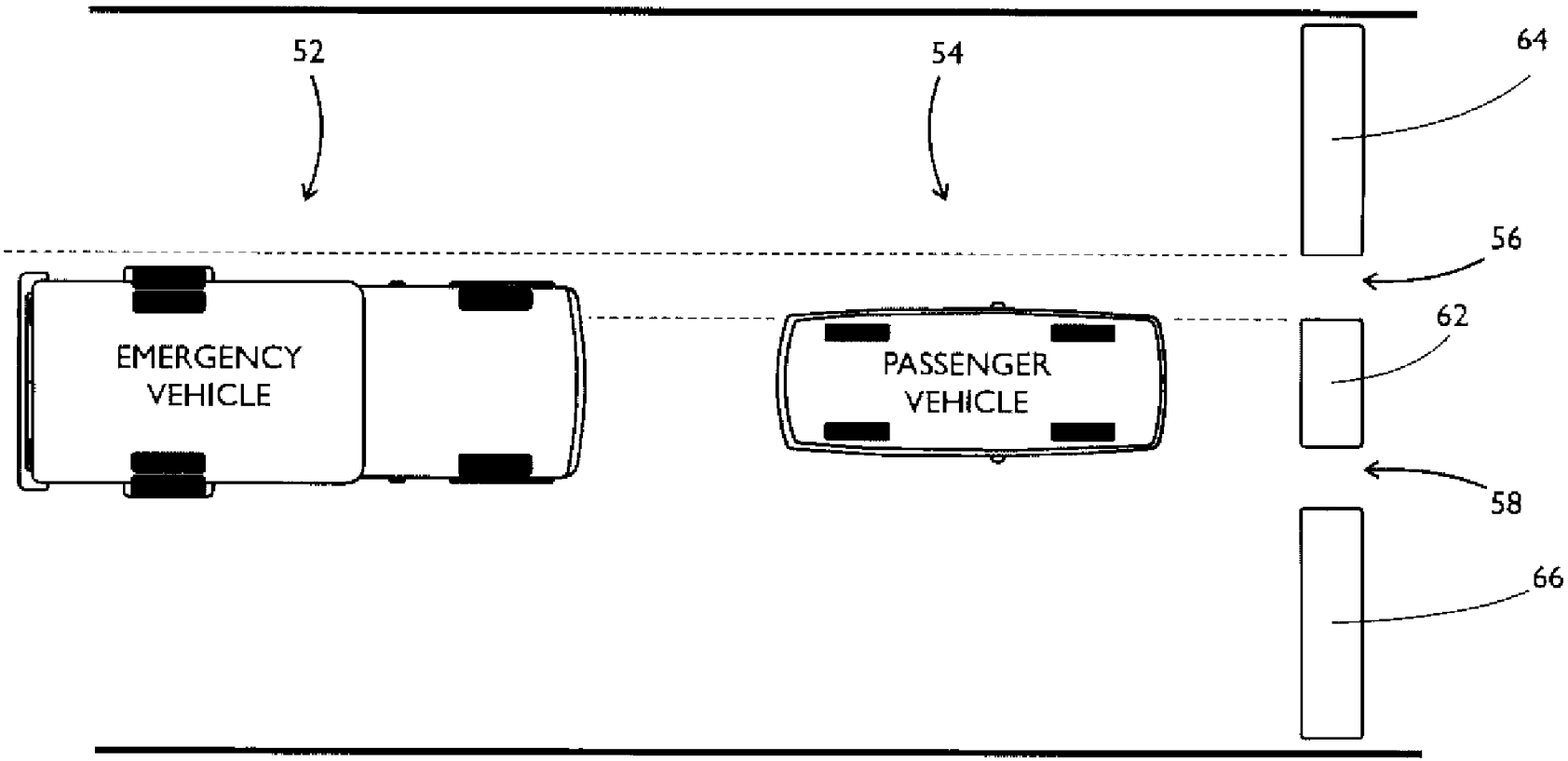
FIG. 1F is a schematic of a tire configuration of an emergency and regular passenger vehicle.

For example, FIG. 1F shows a schematic, in plan view, of a tire configuration 52 of an emergency vehicle and a tire configuration 54 of a regular passenger vehicle that are sufficiently different from each other to allow the emergency vehicle to pass the speed bump system 56 through gaps 58 and 60 unimpeded, but not the regular passenger vehicle. To pass the speed bump system 56, the regular passenger vehicle must go over at least one raised portion 62, 64 or 66.

Figure 2A:
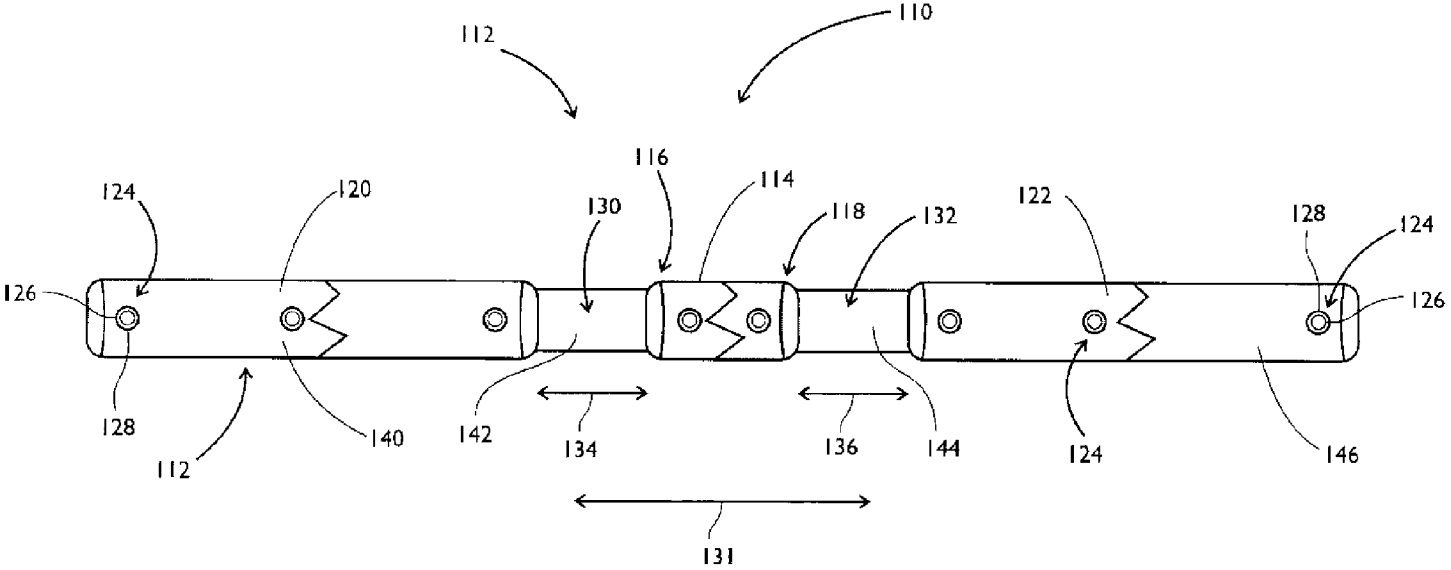
FIG. 2A shows a plan view of another embodiment of a speed bump system, according to the principles of the present invention.

FIG. 2A shows, in a plan view, another embodiment of a speed bump system 110 in which several segments comprise an elongate structure. The speed bump system 110 includes an elongate structure 112 having a raised middle portion 114 with two ends 116 and 118. The elongate structure 112 also has a first raised outer portion 120 that is proximal to the one end 116 of the raised middle portion 114, and a second raised outer portion 122 that is proximal to the other end 118 of the raised middle portion 114. The speed bump system 110 also includes affixing means 124 that can include holes 126 and screws 128 threaded therethrough and screwed to the road. Other affixing means can also be used, such as nails, spikes and rivets.

The speed bump system 110 also includes a first gap 130 and a second gap 132. The first gap 130 lies between the first raised outer portion 120 and the raised middle portion 114. The second gap 132 lies between the second raised outer portion 122 and the raised middle portion 114.

Suppose, for simplicity, that the emergency vehicle has two front tires, and two back tires, and the distance between the two front tires and the distance between the two rear tires is substantially the same. The width 134 of the first gap 130 (the "intragap width") and the width 136 of the second gap 132 are then each chosen to be wider than the width of the widest tire tread of the emergency vehicle. Moreover, the distance 131 between the first and second gaps 130 and 132 (the "intergap width") is chosen to be substantially the same as the distance between the two rear tires of the emergency vehicle, which in this example is substantially the same as the distance between the two front tires. These dimensions allow the emergency vehicle to pass through the first and second gaps 130 and 132.

Figure 2B:
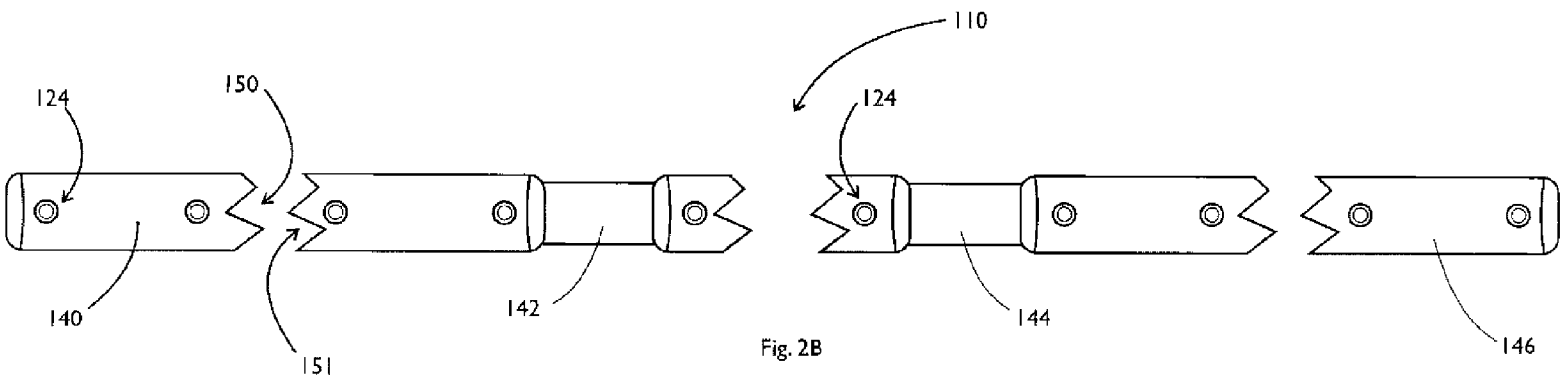
FIG. 2B shows an exploded view of the speed bump system of FIG. 2B.

The elongate structure 112 includes a plurality of segments 140, 142, 144 and 146 that are connected together. FIG. 2B shows these segments 140, 142, 144 and 146 separated from each other. The shape of one end 150 of segment 140 is complimentary to the shape of one end 151 of segment 142 to allow segments 140 and 142 to mate with each other. Likewise, other adjoining segments mate in similar fashion. Conveniently, the segments 140, 142, 144 and 146 can be transported to the installation site where they can be snapped together on site to build the speed bump system 110. Instead of snapping together, in a different embodiment, the segments can simply be abutted or placed next to each other without snapping or locking together. Affixing means 124 affix the segments to the roadway.

Figure 3A:
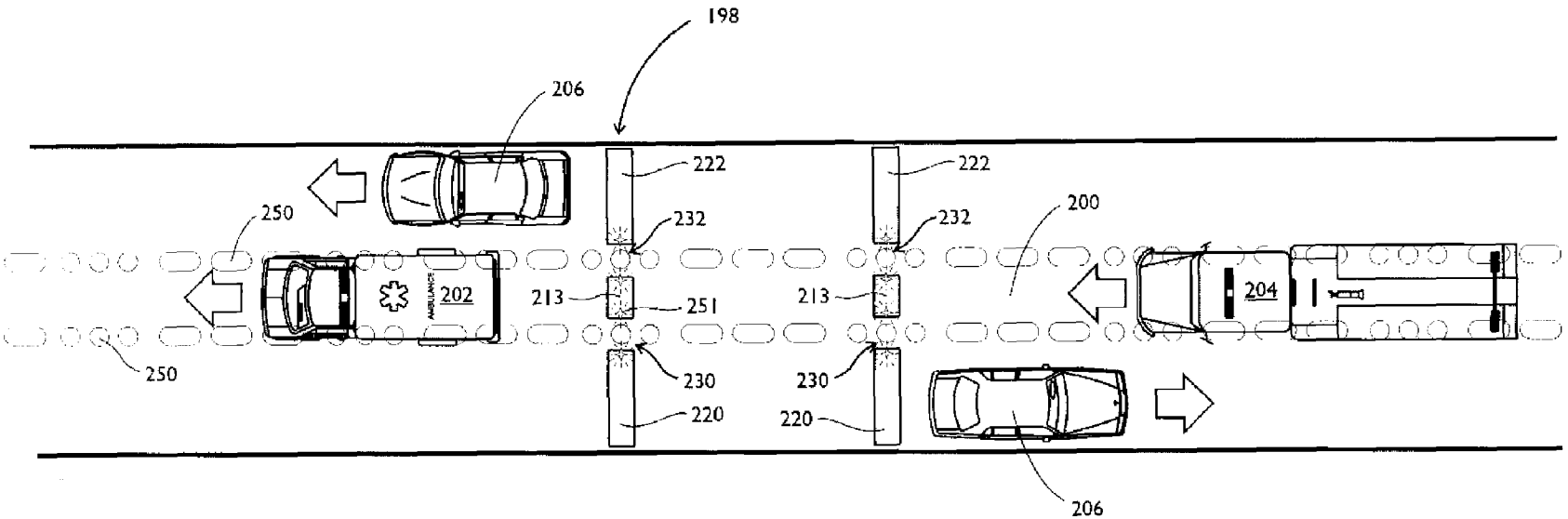
FIG. 3A shows a plan view of a speed bump system having an "SOS lane," according to the principles of the present invention.
Figure 3B:
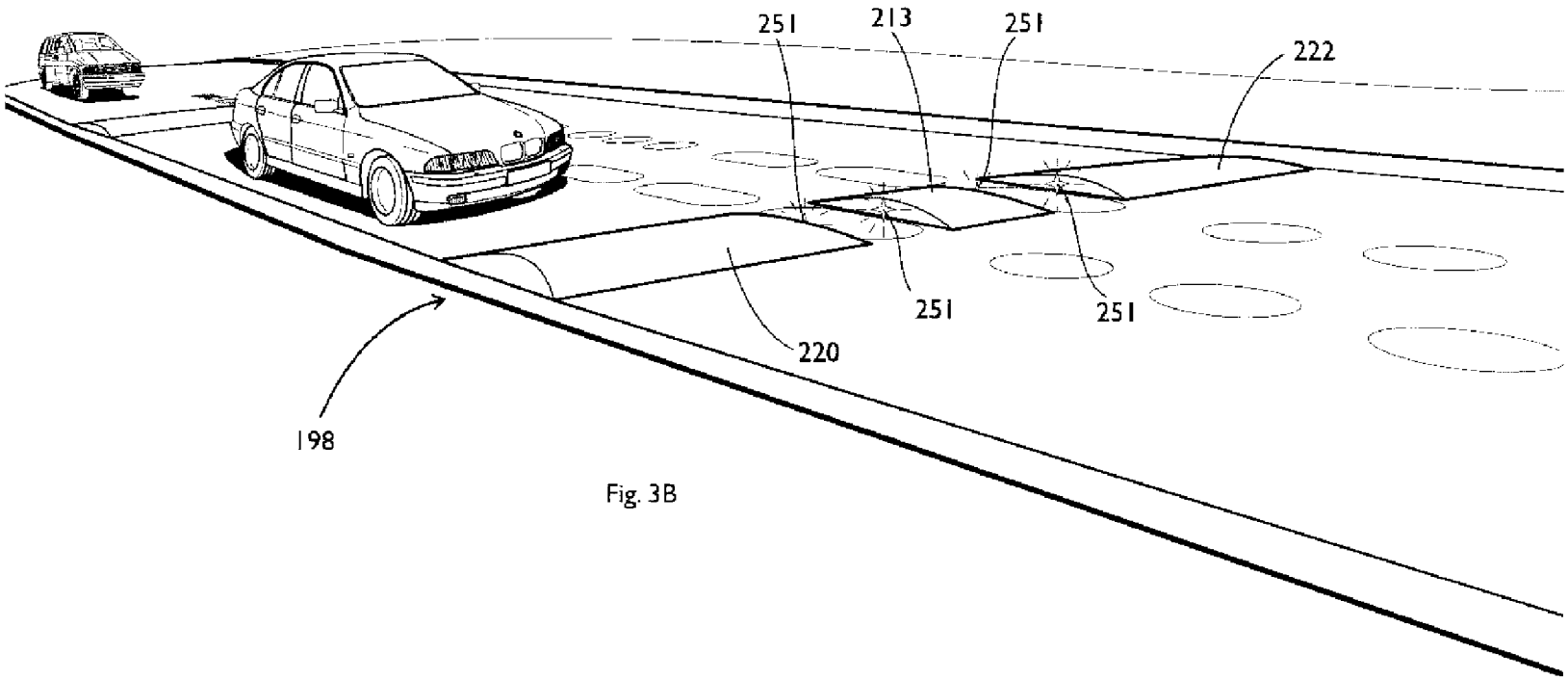
FIG. 3B shows a perspective view of the speed bump system of FIG. 3A.

FIGS. 3A and 3B show a plan view and a perspective view of a speed bump system 198 having an "SOS lane" 200 that allows the wheels of an emergency vehicle traveling thereon to pass through a first gap 230, between a middle raised portion 213 and a first raised outer portion 220, and a second gap 232, between the middle raised portion 213 and a second raised outer portion 222, according to the principles of the present invention. Optionally, the SOS lane 200 can have markings 250. The markings 250 can spell out "SOS" in Morse code. Some or all of these markings can include reflective material for ease of visibility at night. Other reflectors 251 can be disposed in or proximal to the gaps 230 and 232, again for ease of visibility.

The SOS lane 200 is reserved for emergency vehicles, for example an ambulance 202 or fire truck 204. A non-emergency vehicle, such as a regular passenger vehicle 206, would not be permitted to travel in the SOS lane. Instead, the passenger vehicle 206 is permitted to pass the speed bump system by going over the raised portions 220 or 222, thus encouraging the driver to slow down. In contrast, an emergency vehicle 202 or 204 can travel in the SOS lane and pass through the gaps 230 and 232, thus traveling unimpeded. In some embodiments, depending on the intragap and intergap distances chosen, and on the geometries of the wheels of a typical emergency vehicle and a typical passenger vehicle, the typical passenger vehicle cannot pass the speed bump system without going over at least one of the three raised portions 213, 220, 222, as described above.

Figure 4:
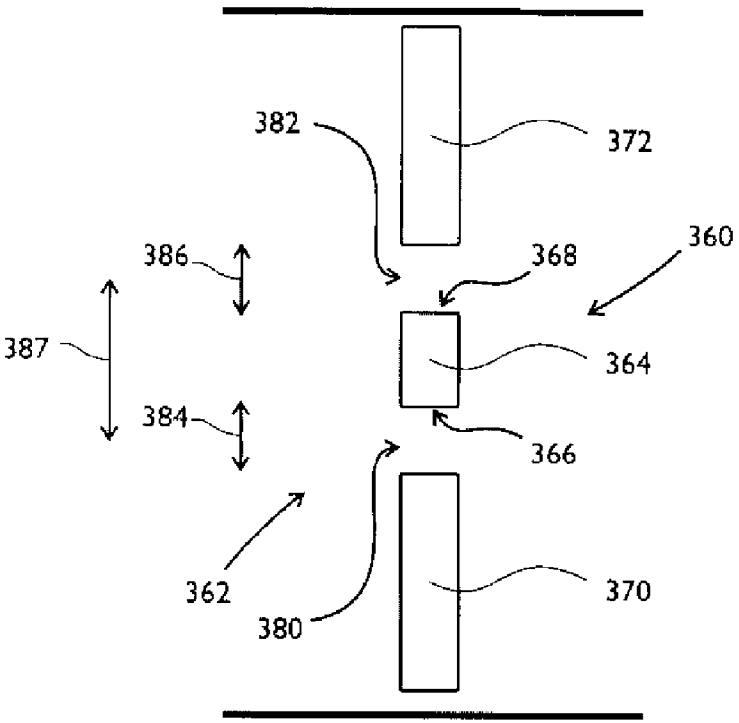
FIG. 4 shows another embodiment of a speed bump system, according to the principles of the present invention.

FIG. 4 shows another embodiment of a speed bump system 360. The speed bump system 360 includes an elongate structure 362 having a raised middle portion 364 with two ends 366 and 368. The elongate structure 362 also has a first raised outer portion 370 that is proximal to the one end 366 of the raised middle portion 364, and a second raised outer portion 372 that is proximal to the other end 368 of the raised middle portion 364.

The speed bump system 360 also includes a first gap 380 and a second gap 382. The first gap 380 lies between the first raised outer portion 370 and the raised middle portion 364. The second gap 382 lies between the second raised outer portion 372 and the raised middle portion 364.

Suppose, for simplicity, that the emergency vehicle has two front tires, and two back tires, and the distance between the two front tires and the distance between the two rear tires is substantially the same. The width 384 of the first gap 380 (the "intragap width") and the width 386 of the second gap 382 are then each chosen to be wider than the width of the widest tire tread of the emergency vehicle. Moreover, the distance 387 between the first and second gaps 380 and 382 (the "intergap width") is chosen to be substantially the same as the distance between the two rear tires of the emergency vehicle, which in this example is substantially the same as the distance between the two front tires. These dimensions allow the emergency vehicle to pass through the first and second gaps 380 and 382.

In the embodiment shown in FIG. 4, the raised middle portion 364, the first raised outer portion 370 and the second raised outer portion 372 are distinct portions, which would be unconnected absent the roadway on which the three portions are disposed. The three portions 364, 370 and 372 can be formed using substances such as tar or asphalt, tamped into shape, for example. These substances, when set, adhere to the roadway, and thus the speed bump system 360 does not require further fastening means.

Figure 5:
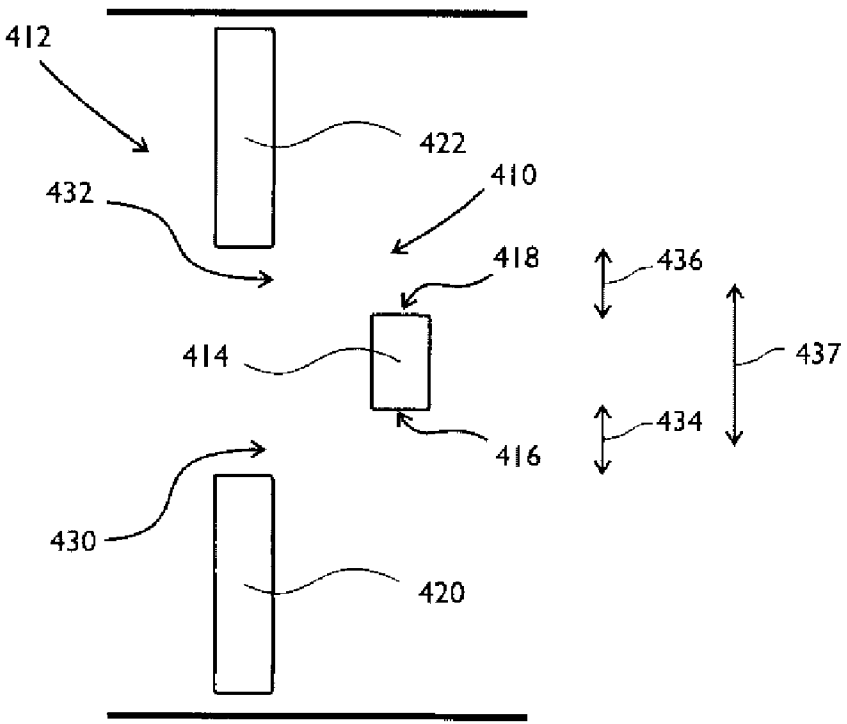
FIG. 5 shows another embodiment of a speed bump system, according to the principles of the present invention.

FIG. 5 shows another embodiment of a speed bump system 410. The speed bump system 410 includes a structure 412 having a raised middle portion 414 with two ends 416 and 418. The structure 412 also has a first raised outer portion 420 that is proximal to the one end 416 of the raised middle portion 414, and a second raised outer portion 422 that is proximal to the other end 418 of the raised middle portion 414.

The speed bump system 410 also includes a first gap 430 and a second gap 432. The first gap 430 lies between the first raised outer portion 420 and the raised middle portion 414. The second gap 432 lies between the second raised outer portion 422 and the raised middle portion 414.

Suppose, for simplicity, the emergency vehicle has two front tires, and two back tires, and the distance between the two front tires and the distance between the two rear tires is substantially the same. The transverse width 434 (i.e., the distance along an imaginary axis perpendicular to the roadway) of the first gap 430 and the transverse width 436 of the second gap 432 are then each chosen to be wider than the width of the widest tire tread of the emergency vehicle. Moreover, the distance 437 between the first and second gaps 430 and 432 is chosen to be substantially the same as the distance between the two rear tires of the emergency vehicle, which in this example is substantially the same as the distance between the two front tires. These dimensions allow the emergency vehicle to pass through the first and second gaps 430 and 432.

Unlike the embodiments shown in FIGS. 1A and 4, the first raised outer portion 420, the raised middle portion 414 and the second raised outer portion 422 are not substantially collinear. In particular, although the first and second raised outer portions 420 and 422 are substantially collinear, the middle portion 414 is staggered relative to the first and second raised outer portions 420 and 422. In other embodiments, other staggering permutations are possible, such as permutations in which none of the three raised portions are collinear, or in which the first outer raised portion and the middle raised portion are collinear, but not the second raised outer portion, etc.

Figure 6:
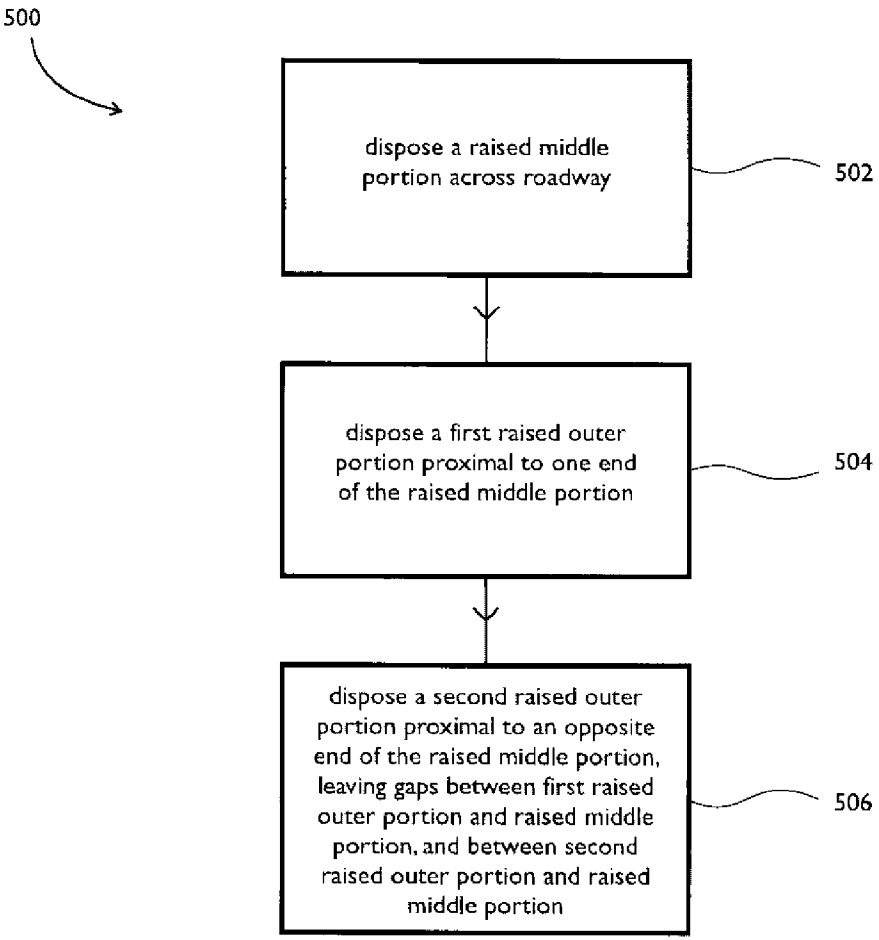
FIG. 6 shows a flow chart of a method for encouraging a driver of a passenger vehicle traveling on a roadway to slow down, while allowing an emergency vehicle to pass therethrough unimpeded, according to the principles of the present invention.

Referring to FIG. 6, a flow chart 500 is shown of a method for encouraging a driver of a passenger vehicle traveling on a roadway to slow down while not substantially impeding an emergency vehicle. In step 502, a raised middle portion is disposed across the roadway. In step 504, a first raised outer portion proximal to one end of the raised middle portion is disposed across the roadway. In step 506, a second raised outer portion proximal to the other end of the raised middle portion is disposed across the roadway. The three raised portions are traversable by the passenger vehicle. In addition, the raised portions are disposed in such a way as to leave a first gap between the first raised outer portion and the raised middle portion, and a second gap between the second raised outer portion and the raised middle portion. The width of the first gap, the width of the second gap and the distance between the first and second gaps allow the emergency vehicle to pass through the first and second gaps. Where the tire configuration of the emergency vehicle and the passenger vehicle is sufficiently different, as shown, for example, in FIG. 1F, the width of the first gap, the width of the second gap and the distance between the first and second gaps can also be chosen so as to not allow the regular passenger vehicle to pass the speed bump system without going over at least one of the raised portions.

Figure 7:
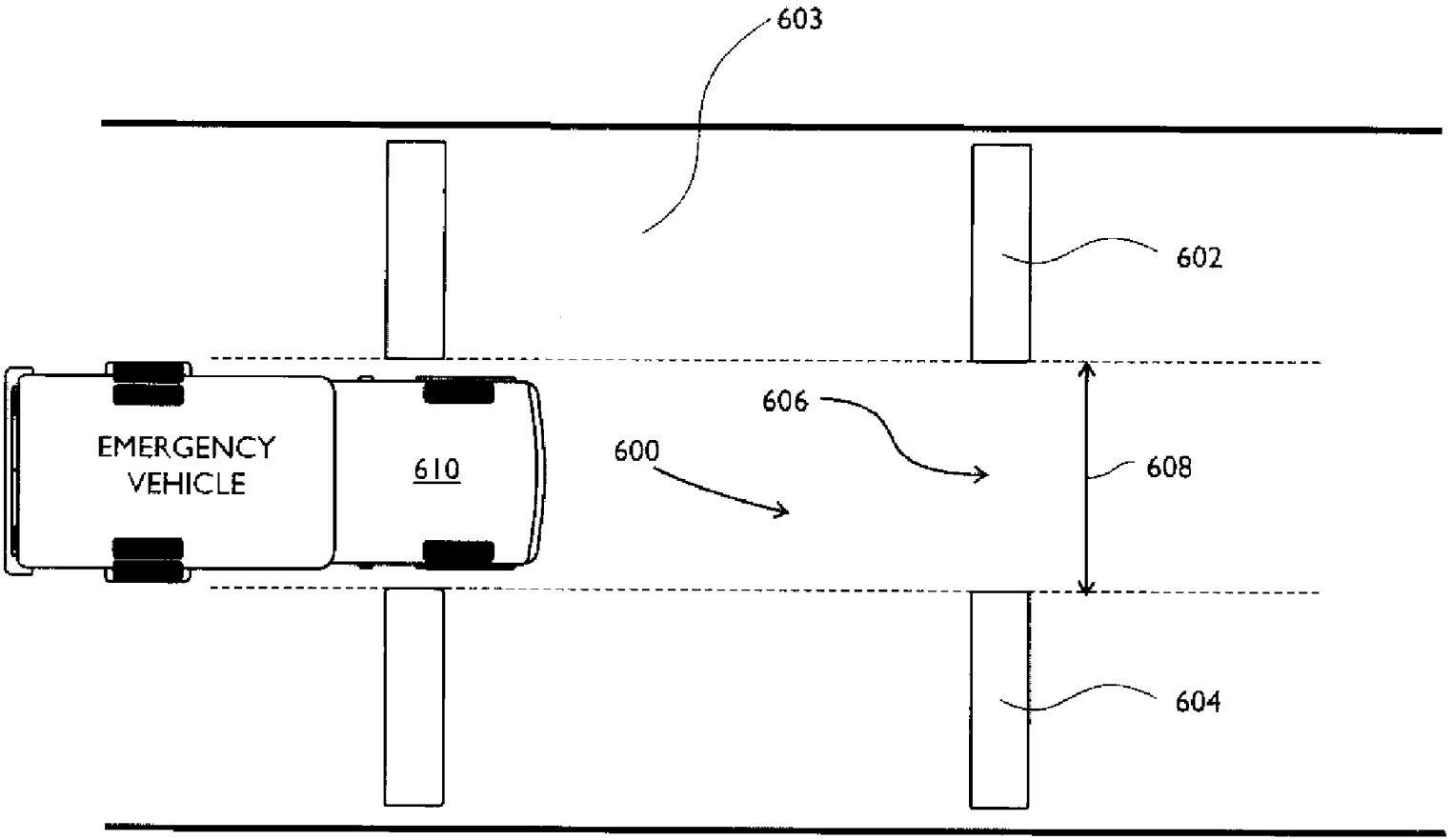
FIG. 7 shows another embodiment of a speed bump system, according to the principles of the present invention.

FIG. 7 shows another embodiment of a speed bump system 600, in accordance with the principles of the present invention. The speed bump system 600 includes a first raised portion 602 disposed across a roadway 603, and a second raised portion 604 disposed across the roadway 603, such that there is a gap 606 between the first raised portion 602 and the second raised portion 604. The width 608 of the gap 606 is large enough to allow an emergency vehicle to pass therethrough unimpeded. If the width 608 is larger that that of a regular passenger vehicle, the vehicle can physically also pass through the gap unimpeded. However, to motivate drivers of regular passenger vehicles to not pass through the gap, laws might be enacted to prohibit unauthorized vehicles from passing through the gap in normal circumstances (exceptions could be made in an emergency).

Figure 8:
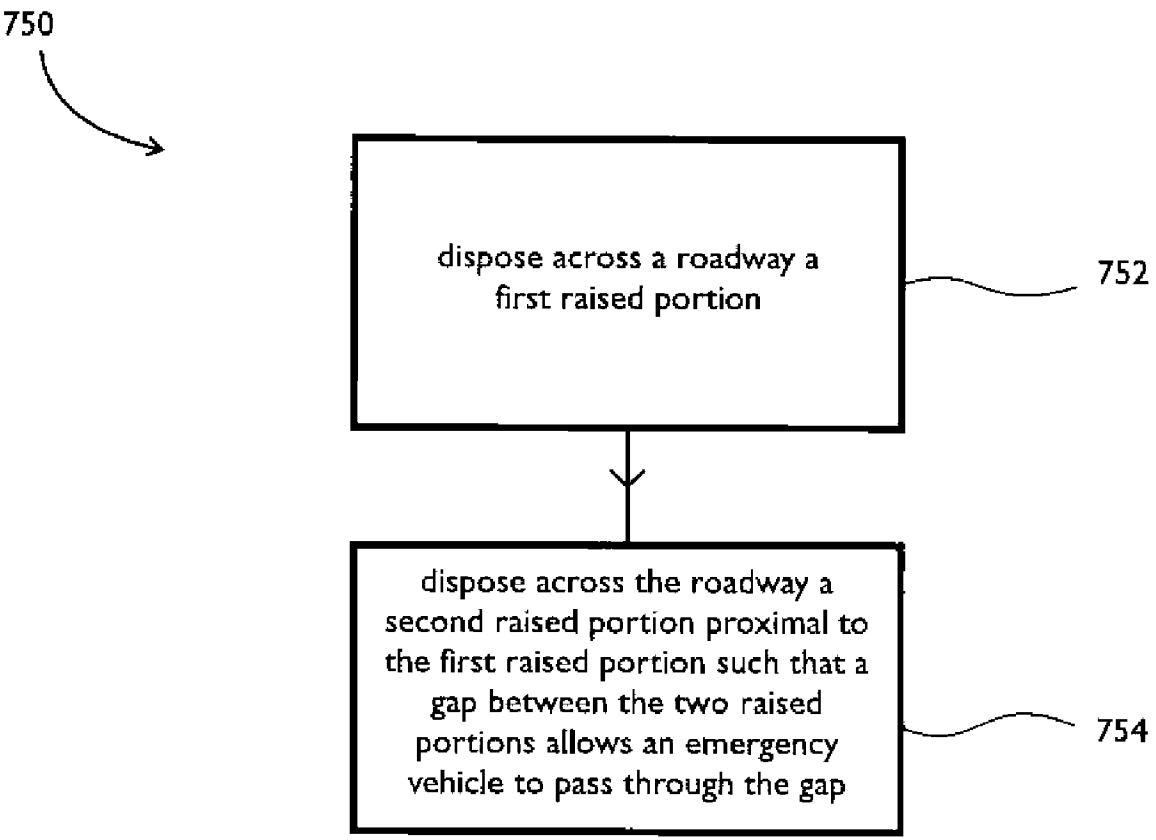
FIG. 8 shows a flow chart of another method for encouraging a driver of a passenger vehicle traveling on a roadway to slow down, while allowing an emergency vehicle to pass therethrough unimpeded, according to the principles of the present invention.

Referring to FIG. 8, a flow chart 750 is shown of another method for encouraging a driver of a passenger vehicle traveling on a roadway to slow down while not substantially impeding an emergency vehicle. In step 752, a first raised portion is disposed across the roadway. In step 754, a second raised portion is disposed across the roadway proximal to the first raised portion. The two raised portions are traversable by the passenger vehicle. In addition, the raised portions are disposed in such a way as to leave a gap between the first raised portion and the second raised portion. The width of the gap allows the emergency vehicle to pass therethrough.

Figure 9:
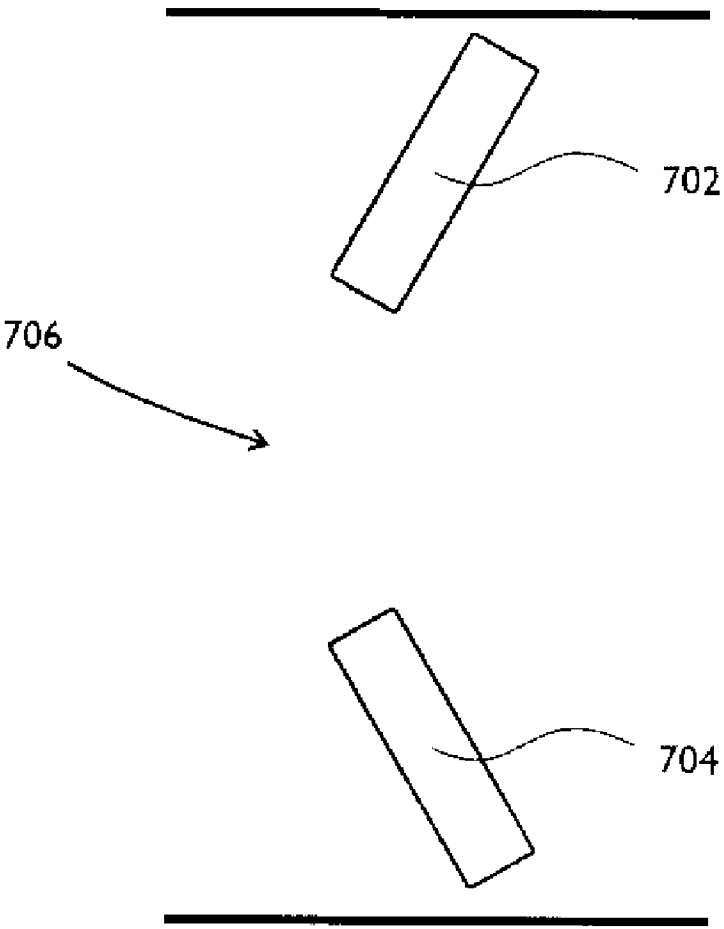
FIG. 9 shows yet another embodiment of a speed bump system, in accordance with the principles of the present invention.

With reference to FIG. 9, showing another embodiment of a speed bump system 700 of the present invention, raised portions 702 and 704 need not be completely perpendicular to the roadway. Thus, for example, the raised portion 702 has a non-zero component in a direction parallel to the roadway. However, the raised portion 702 also has a component in a direction perpendicular to the roadway that is large enough to impede regular passenger vehicles driving along the roadway. In this last embodiment, for the passenger vehicle to pass the speed bump system 700, it would have to go through the gap 706 between the raised portions 702 and 704, as described above.

It should also be understood that the raised portion need not be any particular shape, again as long as the shape impeded a regular passenger vehicle from passing the speed bump system in any manner except through the gap or gaps.

Also, the height of a raised portion need not be uniform along its longitudinal length. For example, the middle raised portion might be higher near the middle than near the ends thereof. Also, one of the raised portions might have a different height than another one of the raised portions.

While embodiments of this invention have been illustrated in the accompanying drawings and described above, it will be evident to those skilled in the art that changes and modifications may be made therein without departing from the essence of this invention. For example, the middle raised portion, and the first and second outer raised portions of the structure of the speed bump system can be connected to each other by material other than the roadway, or they can be unconnected by material other than the roadway. The examples described above are not meant to limit the scope of the invention, which is to be limited by the following claims.

What is claimed is:

1. A speed bump system for a roadway that encourages a driver of a passenger vehicle to slow down and that does not substantially impede an emergency vehicle, the system comprising a structure for disposing on the roadway to encourage the driver of a passenger vehicle to slow down before driving over the structure, the structure including a raised middle portion, a first raised outer portion proximal to one end of the raised middle portion, a second raised outer portion proximal to the other end of the raised middle portion, which three raised portions are traversable by the passenger vehicle, a first gap between the first raised outer portion and the raised middle portion, the first gap having a first width, and a second gap between the second raised outer portion and the raised middle portion, the second gap having a second width, wherein a) the first width, the second width and the distance between the first and second gaps allow the emergency vehicle to pass through the first and second gaps, b) the shortest distance between the first raised outer portion and the second raised outer portion is at least about 102 inches, and c) the first width is about 30 inches, and the second width is about 30 inches.

* * * * *